US011195486B2

(12) United States Patent
Wang

(10) Patent No.: US 11,195,486 B2
(45) Date of Patent: Dec. 7, 2021

(54) DRIVING DEVICE AND DRIVING METHOD THEREOF

(71) Applicant: HKC Corporation Limited, Guangdong (CN)

(72) Inventor: Mingliang Wang, Guangdong (CN)

(73) Assignee: HKC Corporation Limited, Guangdong (CN)

( * ) Notice: Subject to any disclaimer, the term of this patent is extended or adjusted under 35 U.S.C. 154(b) by 0 days.

(21) Appl. No.: 17/042,454

(22) PCT Filed: Dec. 26, 2018

(86) PCT No.: PCT/CN2018/123849
§ 371 (c)(1),
(2) Date: Sep. 28, 2020

(87) PCT Pub. No.: WO2020/118774
PCT Pub. Date: Jun. 18, 2020

(65) Prior Publication Data

US 2021/0125573 A1 Apr. 29, 2021

(30) Foreign Application Priority Data

Dec. 13, 2018 (CN) ..... 201811524372.9

(51) Int. Cl.
*G09G 3/36* (2006.01)
*G09G 5/00* (2006.01)

(52) U.S. Cl.
CPC ..... *G09G 3/3648* (2013.01); *G09G 3/3685* (2013.01); *G09G 5/001* (2013.01);
(Continued)

(58) Field of Classification Search
CPC ..... G09G 2310/08; G09G 2340/16; G09G 2320/103; G09G 2320/0247;
(Continued)

(56) References Cited

U.S. PATENT DOCUMENTS 7,414,795 B2 8/2008 Cok
8,259,050 B2 9/2012 Yun
(Continued)

FOREIGN PATENT DOCUMENTS

CN 101232573 A 7/2008
CN 102006423 A 4/2011
(Continued)

OTHER PUBLICATIONS

International Search Report for Application No. PCT/CN2018/123849 dated Sep. 11, 2019, 2 pages.
(Continued)

*Primary Examiner* — Dismery Mercedes
(74) *Attorney, Agent, or Firm* — Seyfarth Shaw LLP

(57) ABSTRACT

A driving device and a driving method thereof. The driving device comprises a system-on-chip and a timing control board. The system-on-chip is set to receive and process image data signals of frames to be transmitted, and output a first image data signal and a difference signal between image data signals of the current frame and the previous frame. The timing control board is set to process the first image data signal, then output a second image data signal, and to perform the output according to the difference signal and the second image data signals of the current frame and the previous frame.

18 Claims, 3 Drawing Sheets

(52) U.S. Cl.
CPC ..... *G09G 5/003* (2013.01); *G09G 2310/0291* (2013.01); *G09G 2310/08* (2013.01); *G09G 2320/0247* (2013.01); *G09G 2320/0257* (2013.01); *G09G 2320/0673* (2013.01); *G09G 2360/18* (2013.01)

(58) Field of Classification Search
CPC ..... G09G 2320/0257; G09G 2360/18; G09G 2360/12; G09G 2370/08; G09G 2370/14; G09G 3/3648; G09G 5/001; G09G 5/003; G09G 5/006; G09G 5/393; G09G 5/563; G06F 3/0416; G06F 3/0412; G06F 3/14; H04N 13/144
See application file for complete search history.

(56) References Cited

U.S. PATENT DOCUMENTS

| | | | | |
|---|---|---|---|---|
| 9,898,999 | B2 * | 2/2018 | Bae | G09G 5/04 |
| 10,082,860 | B2 | 9/2018 | Pourbigharaz et al. | |
| 10,096,304 | B2 * | 10/2018 | Kim | G09G 5/395 |
| 10,255,866 | B2 | 4/2019 | Yu et al. | |
| 10,878,772 | B2 * | 12/2020 | Tanaka | G09G 3/006 |
| 2012/0206467 | A1 * | 8/2012 | Shih | G09G 3/344 345/545 |
| 2016/0086565 | A1 * | 3/2016 | Ryu | G09G 5/003 345/211 |
| 2016/0210900 | A1 * | 7/2016 | Kim | G09G 3/3233 |

FOREIGN PATENT DOCUMENTS

| | | | |
|---|---|---|---|
| CN | 102103841 | A | 6/2011 |
| CN | 102158633 | A | 8/2011 |
| CN | 102640207 | A | 8/2012 |
| CN | 105761695 | A | 7/2016 |
| CN | 106547396 | A | 3/2017 |
| JP | 2008070783 | A | 3/2008 |
| KR | 20090039885 | A | 4/2009 |
| WO | 2006123706 | A1 | 11/2006 |

OTHER PUBLICATIONS

Chinese Office Action for Application No. 201811524372.9 dated Feb. 3, 2020, 6 pages.

* cited by examiner

DRIVING DEVICE AND DRIVING METHOD THEREOF

CROSS REFERENCE TO RELATED APPLICATIONS

This application is a U.S. National Stage application of, and claims priority to, PCT/CN2018/123849, filed Dec. 26, 2018, which further claims priority to Chinese Patent Application No. 201811524372.9, filed Dec. 13, 2018, the entire contents of which are incorporated herein in their entirety.

TECHNICAL FIELD

This application relates to the field of display technologies, and in particular, to driving devices and driving methods thereof.

BACKGROUND

The description herein provides only background information related to this application, which does not necessarily constitute exemplary examples.

A display framework of a prior television comprises a mainboard and a control board of the television. The mainboard of the television is configured to receive an input signal, e.g., input from an antenna or a set top box, process the signal by a system on chip (SOC), transfer the signal to a timing controller (TCON) on the control board for reprocessing, and finally drive a liquid crystal panel by using a data driving chip.

However, a signal originally received from the antenna or the set top box is substantially changed after being processed by the SOC and the TCON. For a static-image display, display data at a same display position is theoretically fixed. However, after being processed by the SOC and the TCON, it is possible for display data in succession at a display position. In addition, after the long series of procedural processing, a signal difference grows greater and greater, and a problem of image flickering is caused.

SUMMARY

Embodiments of this application provide a driving device and driving method thereof.

A driving device, connected to a signal output circuit and a display panel, respectively, and comprising:

an SOC, connected to the signal output circuit and configured to store an image data signal of each frame that is output by the signal output circuit and that is to be transmitted, and output a first image data signal after processing the image data signal, wherein the SOC is further configured to output a difference signal based on a signal difference between the image data signal of any current frame and the image data signal of a previous frame thereof; and a TCON, connected to the display panel and configured to receive the first image data signal and the difference signal, process the first image data signal based on the first image data signal and the difference signal, and output a second image data signal, wherein if the signal difference is smaller than a first specified value, the TCON is configured to:

output the second image data signal of the previous frame when a signal difference between the second image data signal of any current frame and the second image data signal of the previous frame thereof is greater than a second specified value; and output the second image data signal of the current frame when the signal difference between the second image data signal of the current frame and the second image data signal of the previous frame thereof is smaller than the second specified value.

A driving device, comprising an SOC and a TCON. The SOC comprises:

a first buffer circuit, connected to a signal output circuit, and configured to store and output an image data signal of each frame that is output by the signal output circuit and that is to be transmitted;

a data comparison circuit, wherein an input end of the data comparison circuit is connected to the signal output circuit and the first buffer circuit, and the data comparison circuit is configured to output a difference signal based on a signal difference between the image data signal of any current frame and the image data signal of a previous frame thereof;

a first processing circuit, connected to the first buffer circuit, and configured to receive the image data signal, and output a first image data signal after processing the image data signal; and an encoding circuit, wherein an input end of the encoding circuit is connected to the data comparison circuit and the first processing circuit, an output end of the encoding circuit is connected to the TCON, and wherein the encoding circuit is configured to receive the difference signal and the first image data signal, encode the difference signal and the first image data signal, and output the same; and the TCON comprises:

a decoding circuit, connected to the encoding circuit, and configured to decode and output the difference signal and the first image data signal that are encoded by the encoding circuit;

a second processing circuit, connected to the decoding circuit, and configured to receive the decoded first image data signal, and output a second image data signal after processing the first image data signal;

a second buffer circuit, connected to the second processing circuit, and configured to store and output the second image data signal; and a selection circuit, wherein an input end of the selection circuit is connected to the decoding circuit, the second processing circuit, and the second buffer circuit; an output end of the selection circuit is connected to a display panel; the selection circuit is configured to receive the difference signal, the second image data signal of a current frame, and the second image data signal of a previous frame; and the selection circuit is configured to output the second image data signal of the previous frame when the signal difference is smaller than a first specified value and a signal difference between the second image data signal of the current frame and the second image data signal of the previous frame thereof is greater than a second specified value; and output the second image data signal of the current frame when the signal difference is smaller than the first specified value and the signal difference between the second image data signal of the current frame and the second image data signal of the previous frame thereof is smaller than the second specified value.

A driving method, comprising:

receiving, by an SOC, an image data signal of each frame that is to be transmitted, and outputting a first image data signal after processing the image data signal; and outputting a difference signal based on a signal difference between the image data signal of any current frame and the image data signal of a previous frame thereof;

outputting, by a TCON, a second image data signal after processing the first image data signal based on the difference signal and the first image data signal;

outputting, by the TCON, the second image data signal of a current frame when the signal difference is smaller than a first specified value and a signal difference between the second image data signal of the current frame and the second image data signal of a previous frame is smaller than a second specified value; and outputting, by the TCON, the second image data signal of the previous frame when the signal difference is smaller than the first specified value and the signal difference between the second image data signal of the current frame and the second image data signal of the previous frame thereof is greater than the second specified value.

The foregoing driving device resolves a problem that the image data signal in the driving device is substantially changed after being processed by the SOC and the TCON, which causes a static image flicker.

BRIEF DESCRIPTION OF THE DRAWINGS

To illustrate the technical solutions according to the embodiments of the present invention or in the exemplary examples more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

When an element is referred to as being "coupled" or "connected" to another element, it can be directly coupled or connected to the other element or intervening elements may also be present. Unless otherwise defined, all technical and scientific terms used herein have the same meaning as commonly understood by persons skilled in the art to which this application pertains. The terminology used in the description of this application herein is for describing particular embodiments only and is not intended to be limiting of this application.

Figure 1:
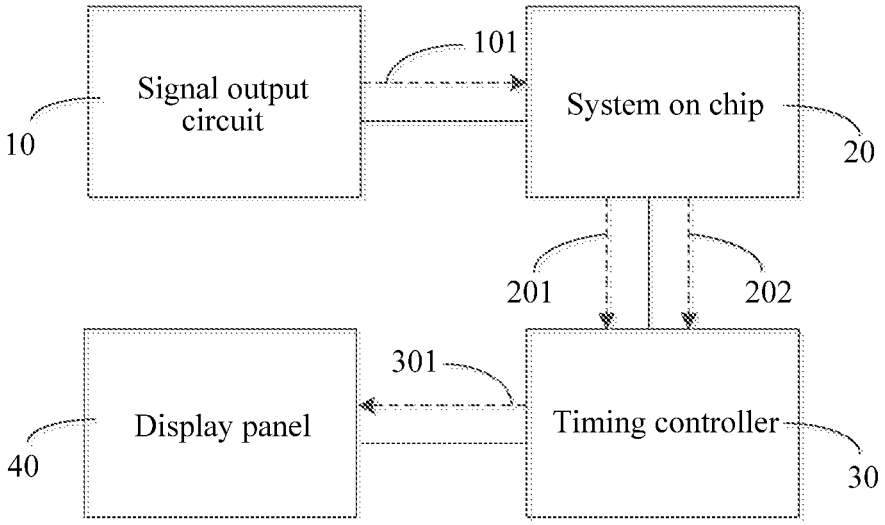
FIG. 1 shows a schematic structural diagram of a driving device according to an embodiment.

Now refer to FIG. 1. FIG. 1 shows a schematic structural diagram of a driving device according to an embodiment.

A driving device is provided, which may be connected to a signal output circuit 10 and a display panel 40, and may comprise:

an SOC 20, connected to the signal output circuit 10, and configured to store an image data signal of each frame 101 that is output by the signal output circuit 10 and that is to be transmitted, and output a first image data signal 201 after processing the image data signal 101, where the SOC 20 may be further configured to output a difference signal 202 based on a signal difference between the image data signal of any current frame and the image data signal of a previous frame thereof; and a TCON 30, connected to the display panel 40, and configured to receive the first image data signal 201 and the difference signal 202, and output, based on the first image data signal 201 and the difference signal 202, a second image data signal 301 after processing the first image data signal 201, where if the signal difference is smaller than a first specified value, the TCON 30 is configured to:

output the second image data signal of a previous frame when a signal difference between the second image data signal of a current frame and the second image data signal of a previous frame thereof is greater than a second specified value; and output the second image data signal of the current frame when the signal difference between the second image data signal of the current frame and the second image data signal of the previous frame thereof is smaller than the second specified value.

The foregoing driving device may comprise the SOC 20 and the TCON 30. In addition to being configured to receive the image data signal 101 of each frame that is output by the signal output circuit 10 and that is to be transmitted, and output the first image data signal 201 after processing the image data signal 101, the SOC 20 may be further configured to output the difference signal 202 based on the signal difference between the image data signal of any current frame and the image data signal of the previous frame thereof. The signal output circuit 10 may be an antenna or a set top box. The TCON 30 outputs, based on the first image data signal 201 and the difference signal 202, the second image data signal 301 after processing the first image data signal 201. Specifically, the TCON 30 may output the second image data signal of the previous frame when the signal difference is smaller than the first specified value and the signal difference between the second image data signal of the current frame and the second image data signal of the previous frame thereof is greater than the second specified value; and the TCON 30 may output the second image data signal of the current frame when the signal difference is smaller than the first specified value and the signal difference between the second image data signal of the current frame and the second image data signal of the previous frame thereof is smaller than the second specified value. In this way, a problem that the image data signal 101 in the driving device is substantially changed after being processed by the SOC 20 and the TCON 30, which causes a static image flickering, may be more effectively resolved.

Figure 2:
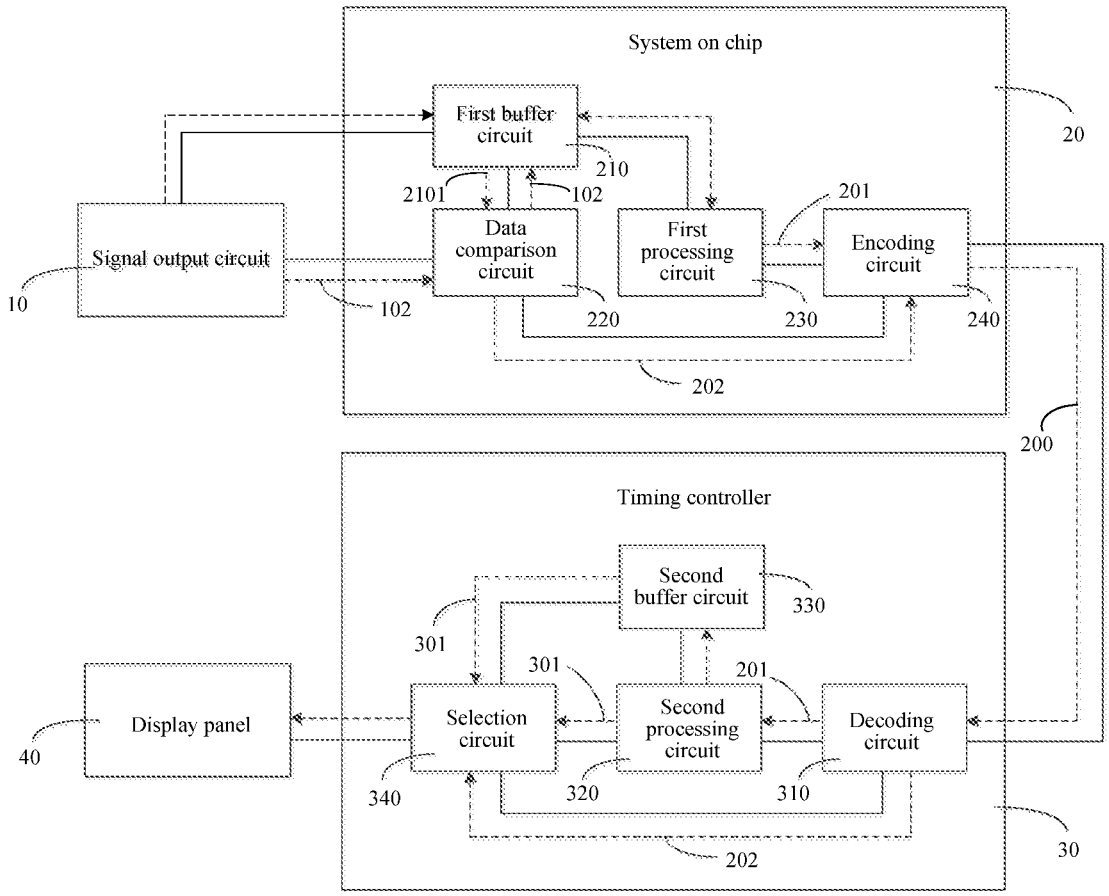
FIG. 2 shows a schematic structural diagram of a driving device according to another embodiment.

In an embodiment, FIG. 2 shows a schematic structural diagram of a driving device according to another embodiment. An SOC 20 is provided, comprising:

a first buffer circuit 210, connected to a signal output circuit 10, and configured to store and output an image data signal of each frame that is output by the signal output circuit 10 and that is to be transmitted;

a data comparison circuit 220, where an input end of the data comparison circuit 220 may be connected to the signal output circuit 10 and the first buffer circuit 210, and the data comparison circuit 220 may be configured to output a difference signal 202 based on a signal difference between any current frame of image data signal 102 and a previous frame of the image data signal of the current frame 2101; and a first processing circuit 230, connected to the first buffer circuit 210, and configured to receive the image data signal, and output a first image data signal 201 after processing the image data signal.

Further, the SOC 20 may further comprise:

an encoding circuit 240, where an input end of the encoding circuit 240 may be connected to the data comparison circuit 220 and the first processing circuit 230, an output end of the encoding circuit 240 may be connected to a TCON 30, wherein the encoding circuit 240 is configured to receive the difference signal 202 and the first image data signal 201, encode the difference signal 202 and the first image data signal 201, and output the same.

Specifically, the encoding circuit 240 may be a low voltage differential signal (LVDS) encoder.

In this embodiment, the TCON 30 may comprise:

a second processing circuit 320, connected to the first processing circuit 230, and configured to receive the first image data signal 201, and output a second image data signal 301 after processing the first image data signal 201;

a second buffer circuit 330, connected to the second processing circuit 320, and configured to store and output the second image data signal 301; and a selection circuit 340, where an input end of the selection circuit 340 may be connected to the data comparison circuit 220, the second processing circuit 320, and the second buffer circuit 330, an output end of the selection circuit 340 may be connected to a display panel 40, the selection circuit 340 may be configured to receive the difference signal 202, the second image data signal of a current frame, and the second image data signal of a previous frame, and the selection circuit 340 may be configured to output the second image data signal of the previous frame when the signal difference is smaller than a first specified value and a signal difference between the second image data signal of the current frame and the second image data signal of the previous frame thereof is greater than a second specified value; and output the second image data signal of the current frame when the signal difference is smaller than the first specified value and the signal difference between the second image data signal of the current frame and the second image data signal of the previous frame thereof is smaller than the second specified value.

Further, the TCON 30 may also comprise:

a decoding circuit 310, connected to the encoding circuit 240, and configured to decode and output the difference signal 202 and the first image data signal 201 that are encoded by the encoding circuit 240.

Specifically, the decoding circuit 310 may be an LVDS decoder.

In this embodiment, a data comparison circuit 220 may be newly added into the SOC 20, which compares the differences of original input signals, that is, the signal difference between the image data signal of the current frame 102 and the image data signal of the previous frame 2101, and set an identifier to be zero when the signal difference is smaller than the first specified value and to be one when the signal difference is greater than the first specified value. Then, when protocol encoding is performed by the encoding circuit 240, the difference identifier may be also encoded into a protocol, equivalent to adding new code to an existing protocol.

Figure 3:
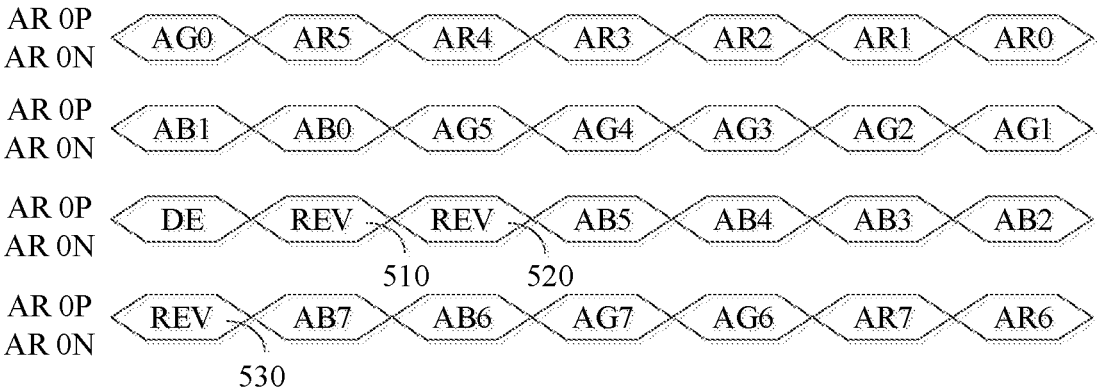
FIG. 3 shows an encoding principle of an encoding circuit according to another embodiment.

FIG. 3 shows an encoding principle of the encoding circuit 240 in this embodiment. The LVDS encoder may be used herein, wherein P and N are a pair. There may be four pairs of differential signals from 0 to 3. Image data signals include red data signals, green data signals, and blue data signals. The data signals in the three colors may be incorporated in the four pairs of differential signals, wherein AR0 to AR7 may be the red data signals, AG0 to AG7 may be the green data signals, and AB0 to AB7 may be the blue data signals. Three reserved positions REV are not currently used. In this embodiment, the three reserved positions REV are used to place difference signals. Specific positions of a red data difference signal, a green data difference signal, and a blue data difference signal are not limited, provided that the red data difference signal, the green data difference signal, and the blue data difference signal are within the three reserved positions REV.

When the difference signal 202 is included in a new transmission protocol, the difference signal 202 may be transmitted to the TCON 30. The TCON 30 needs to perform new protocol decoding on an encoded signal 200. The decoded first image data signal 201 and difference signal 202 still need to be preprocessed. The decoded difference signal 202 needs to be used by the selection circuit 340 as a criterion of data determining. The selection circuit 340 re-determines the difference between the second image data signal of the previous frame and the second image data signal of the current frame, and finally determines to output data.

Figure 4:
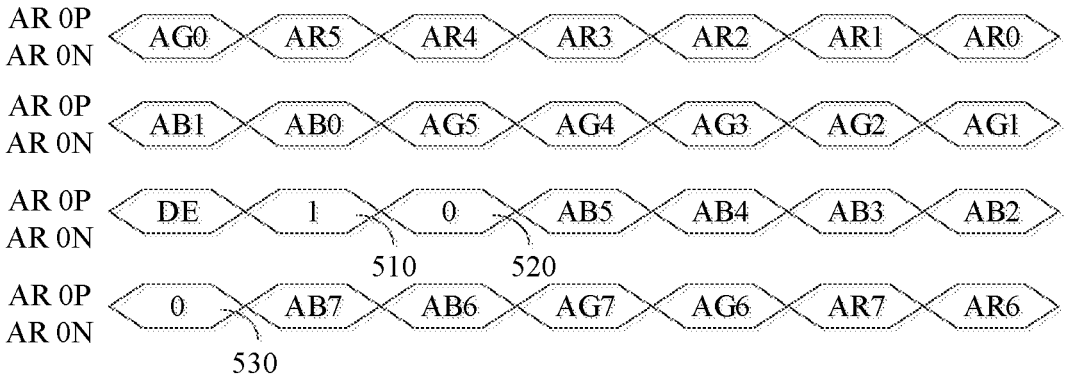
FIG. 4 shows an example of an encoding circuit according to another embodiment.

Now refer to FIG. 4. FIG. 4 shows an example of the encoding circuit 240 in this embodiment, in which the difference signals of the red data signal, the green data signal, and the blue data signal are respectively placed at a position 530, a position 510, and a position 520. When a signal difference between the red data signal of a previous frame and the red data signal of a current frame and a signal difference between the blue data signal of a previous frame and the blue data signal of a current frame are both smaller than the first specified value, the corresponding position 530 and position 520 are encoded as 0, which indicates that determining processing of the TCON 30 is required. On the contrary, when a signal difference between the green data signal of a current frame and the green data signal of a previous frame is greater than the first specified value, the corresponding position 510 is encoded as 1, which indicates that determining processing of the TCON 30 is not required.

When the difference identifiers of the red data signal and the blue data signal are 0, if the selection circuit 340 determines that the signal difference between the second image data signal of the previous frame and the second image data signal of the current frame is greater than the second specified value, it may be considered that a relatively large difference of a signal is already caused from an input from a source to a current terminal, which may in turn cause a problem may be caused; therefore, a the second image data signal of the previous frame is selected for output. If the selection circuit 340 determines that the signal difference between the second image data signal of the previous frame and the second image data signal of the current frame is smaller than the second specified value, then the second image data signal of the current frame may be selected for output.

Further, the first processing circuit 230 may comprise:

an expander circuit, connected to the first buffer circuit, and configured to receive the image data signal, and output the first image data signal after expanding the image data signal.

Specifically, the expander circuit may comprise:

a row expander circuit, connected to the first buffer circuit, and configured to extract each row of data from the image data signal, and perform row expanding on the row of data; and a column expander circuit, connected to the row expander circuit, and configured to extract each column of data of the image data signal on which the row expanding is performed, and perform column expanding on the column of data.

The expander circuit may comprise the row expander circuit and the column expander circuit mainly to adjust a full high definition image data signal received to an ultra high definition image data signal, so as to adapt to a display panel of ultra high definition.

Figure 5:
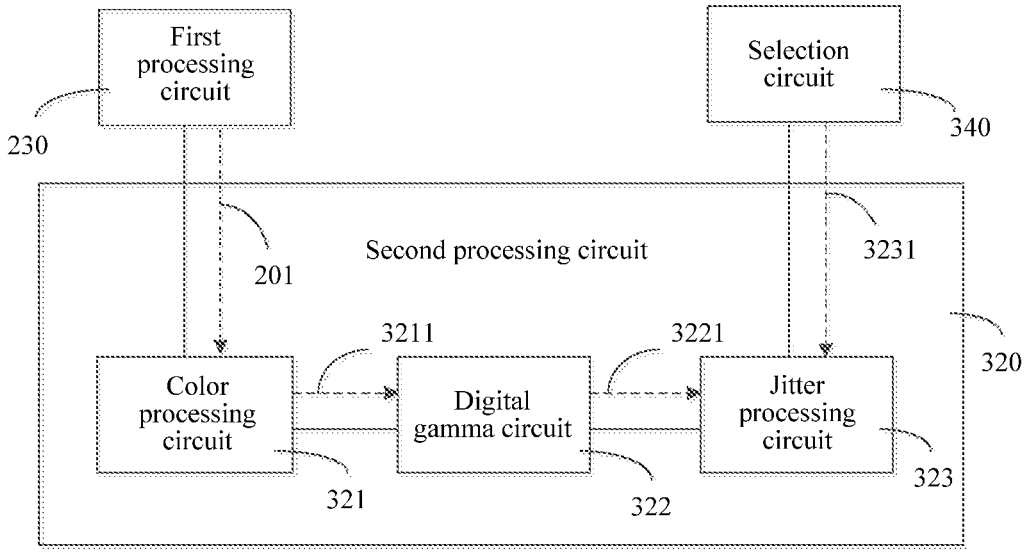
FIG. 5 shows a schematic structural diagram of a second processing circuit according to an embodiment.

Further, FIG. 5 shows a schematic structural diagram of a second processing circuit 320 according to an embodiment. The second processing circuit 320 may comprise:

a color processing circuit 321, connected to a first processing circuit 230, configured to receive a first image data signal 201 and correct the first image data signal 201 by searching a lookup table stored in the color processing circuit 321, wherein the lookup table may be a signal correction table of the first image data signal 201 that is input and a first image data signal 3211 that is output.

The color processing circuit 321 may perform data replacement on the decoded first image data signal 201, and may output the corrected first image data signal 3211 by searching the lookup table for a matchup of input/output data. This is mainly to improve vividness of an image.

Further, the second processing circuit 320 may further comprise:

a digital gamma circuit 322, connected to the color processing circuit 321, configured to receive the first image data signal 3211 corrected by the color processing circuit 321 and convert an original bit number of the corrected first image data signal 3211, where the converted bit number may be greater than the original bit number; and a jitter processing circuit 323, connected to the digital gamma circuit 322, and configured to receive a first image data signal 3221 converted by the digital gamma circuit 322, and output the original bit number of the converted first image data signal 3221 in a jitter manner.

The digital gamma circuit 322 replaces the bit number of the corrected first image data signal 3211. The bit number after replacement is greater than the original bit number. This is mainly to ensure smoothness of a gamma curve. The gamma curve is an optical curve. Brightness presented by a liquid crystal display is different from brightness felt by human eyes. Generally, pupils of human eyes are dilated for a dark gray-scale rate to collect more light. Therefore, to cooperate with the feature of human eyes, displayed data needs to be corrected to satisfy a requirement of the gamma curve, so that all orders of an image in a process from complete black to complete white may be evenly transited, and the image is not likely to abruptly light up or abruptly black out.

The jitter processing circuit 323 may output the bit number after replacement output by the digital gamma circuit 322 in a jitter manner as a data signal of the original bit number. This is because the back-end TCON 30 can identify only the data signal of the original bit number. Therefore, the jitter processing circuit 323 generates, based on data after conversion, new data of the original bit number for output. Because different new data of the original bit number is output at different times, a mixed effect of human eyes is caused, thereby having a visual effect of the bit number after real conversion and a larger gray-scale value for display.

Figure 6:
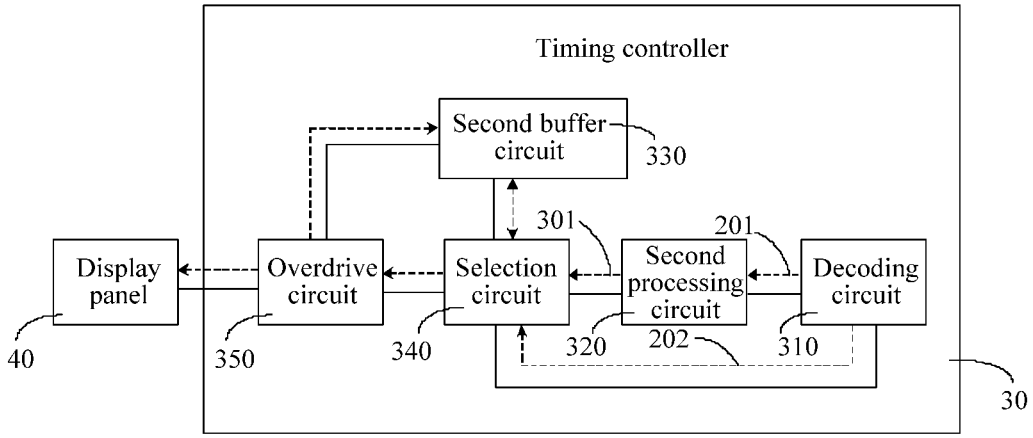
FIG. 6 shows a schematic structural diagram of a TCON according to an embodiment.

Further, refer to FIG. 6. FIG. 6 shows a schematic structural diagram of a TCON 30 according to an embodiment. The TCON 30 may further comprise:

an overdrive circuit 350, wherein an input end of the overdrive circuit 350 may be connected to a selection circuit 340 and a second buffer circuit 330, an output end of the overdrive circuit 350 may be connected to a display panel 40, and wherein the overdrive circuit 350 may be configured to receive the second image data signal of a current frame and the second image data signal of a previous frame, and enhance, by using a signal difference between the second image data signal of the current frame and the second image data signal of the previous frame thereof, a capability of outputting a signal by the selection circuit 340.

The newly added overdrive circuit 350 may serve the purpose of increasing a charging speed of a liquid crystal and reducing a streaking phenomenon of a dynamic image. For example, normally, gray scale of 16 needs to be output, this may be not reached within a charging time, and the overdrive circuit 350 may be set to directly output gray scale of 20. This is equivalent to charge the liquid crystal using a larger voltage, and the gray scale of 16 can be reached with an equal time.

In another embodiment, referring to FIG. 2, a driving device is provided, which may comprise a SOC 20 and a TCON 30. The SOC 20 may comprise:

a first buffer circuit 210, connected to a signal output circuit 10, and configured to store and output an image data signal of each frame that is output by the signal output circuit 10 and that is to be transmitted;

a data comparison circuit 220, where an input end of the data comparison circuit 220 may be connected to the signal output circuit 10 and the first buffer circuit 210, and the data comparison circuit 220 may be configured to output a difference signal 202 based on a signal difference between any current frame of image data signal 102 and a previous frame of the image data signal of the current frame 2101;

a first processing circuit 230, connected to the first buffer circuit 210, and configured to receive the image data signal, and output a first image data signal 201 after processing the image data signal; and an encoding circuit 240, where an input end of the encoding circuit 240 may be connected to the data comparison circuit 220 and the first processing circuit 230, an output end of the encoding circuit 240 may be connected to the TCON 30, and the encoding circuit 240 may be configured to receive the difference signal 202 and the first image data signal 201, and encode and output the difference signal 202 and the first image data signal 201.

The TCON 30 may comprise:

a decoding circuit 310, connected to the encoding circuit 240, and configured to decode and output the difference signal 202 and the first image data signal 201 that are encoded by the encoding circuit 240;

a second processing circuit 320, connected to the decoding circuit 310, and configured to receive the decoded first image data signal 201, and output a second image data signal 301 after processing the first image data signal 201;

a second buffer circuit 330, connected to the second processing circuit 320, and configured to store and output the second image data signal 301; and a selection circuit 340, wherein an input end of the selection circuit 340 may be connected to the decoding circuit 310, the second processing circuit 320, and the second buffer circuit 330, an output end of the selection circuit 340 may be connected to a display panel 40; the selection circuit 340 may be configured to receive the difference signal 202, the second image data signal of a current frame, and the second image data signal of a previous frame; and wherein, the selection circuit 340 may be configured to output the second image data signal of the previous frame when the signal difference is smaller than a first specified value and a signal difference between the second image data signal of the current frame and the second image data signal of the previous frame thereof is greater than a second specified value, and output the second image data signal of the current frame when the signal difference is smaller than the first specified value and the signal difference between the second image data signal of the current frame and the second image data signal of the previous frame thereof is smaller than the second specified value.

The foregoing driving device resolves a problem that the image data signal in the driving device may be substantially changed after being processed by the SOC and the TCON, which causes a static image flickering.

A driving method is also provided herein, which may comprise the following steps:

receiving, by an SOC, an image data signal of each frame that is to be transmitted, and outputting a first image data signal after processing the image data signal; and outputting a difference signal based on a signal difference between the image data signal of any current frame and the image data signal of a previous frame thereof;

outputting, by a TCON a second image data signal after processing the first image data signal based on the difference signal and the first image data signal;

outputting, by the TCON, the second image data signal of a current frame when the signal difference is smaller than a first specified value and a signal difference between the second image data signal of the current frame and the second image data signal of a previous frame is smaller than a second specified value; and outputting, by the TCON, the second image data signal of the previous frame when the signal difference is smaller than the first specified value and the signal difference between the second image data signal of the current frame and the second image data signal of the previous frame thereof is greater than the second specified value.

According to the foregoing driving method, in addition to being configured to receive the frame of image data signal that is to be transmitted, and output the first image data signal after processing the image data signal, the SOC may be further configured to output the difference signal based on the signal difference between the image data signal of any current frame and the image data signal of the previous frame thereof. The TCON outputs, based on the first image data signal and the difference signal, the second image data signal after processing the first image data signal. The TCON may output the currents frame of second image data signal if the signal difference is smaller than the first specified value and the signal difference between the second image data signal of the current frame and the second image data signal of the previous frame thereof is smaller than the second specified value; and the TCON may output the second image data signal of the previous frame when the signal difference is smaller than the first specified value and the signal difference between the second image data signal of the current frame and the second image data signal of the previous frame thereof is greater than the second specified value. In this way, a problem that the image data signal in a driving device may be substantially changed after being processed by the SOC and the TCON, which causes a static image flickering is effectively resolved.

Further, the receiving, by an SOC, an image data signal of each frame that is to be transmitted, and outputting a first image data signal after processing the image data signal specifically may comprise:

receiving, by the SOC, the frame of image data signal that is to be transmitted, and outputting the first image data signal after expanding the image data signal.

Specifically, the receiving, by the SOC, the frame of image data signal that is to be transmitted, and outputting the first image data signal after expanding the image data signal may specifically comprise:

extracting, by the SOC, each row of data of the image data signal when receiving the frame of image data signal that is to be transmitted, performing twofold expanding processing on the row of data, extracting each column of data of the image data signal after the processing, and outputting the column of data after performing twofold expanding processing on the column of data.

To achieve an expanding effect, each row of image data signals may be expanded twofold, and each column of image data signals may be expanded twofold, thereby switching a full high definition image data signal to an ultra high definition data signal, to adapt to a display panel displayed in ultra high definition.

Further, the outputting, by a TCON, a second image data signal after processing the first image data signal based on the difference signal and the first image data signal may comprise:

outputting, by the TCON, based on the difference signal and the first image data signal, the second image data signal after correcting the first image data signal. The first image data signal may be corrected by mainly using a color processing module in the TCON. The first image data signal may be corrected by searching a lookup table stored in the color processing circuit. The lookup table may be a signal correction table of the first image data signal that is input and a first image data signal that is output. Correcting the first image data signal may be mainly to improve vividness of an image.

Further, the outputting a second image data signal after processing the first image data signal may further comprise:

converting, by the TCON, an original bit number of the corrected first image data signal, and outputting the original bit number in a jitter manner.

A digital gamma circuit in the TCON converts an original bit number of the corrected first image data signal. A bit number after replacement may be greater than the original bit number. This is mainly to ensure smoothness of a gamma curve. The gamma curve is an optical curve. Brightness presented by a liquid crystal display is different from brightness felt by human eyes. Generally, pupils of human eyes are dilated for a dark gray-scale rate to collect more light. Therefore, to cooperate with the feature of human eyes, displayed data needs to be corrected to satisfy a requirement of the gamma curve, so that all orders of an image in a process from complete black to complete white may be evenly transited, and the image is not likely to abruptly light up or abruptly black out.

A jitter processing circuit in the TCON may output the bit number after replacement output by the digital gamma circuit in a jitter manner as a data signal of the original bit number. This is because the back-end TCON can identify only the data signal of the original bit number. Therefore, the jitter processing circuit generates, based on data after conversion, new data of the original bit number for output. Because different new data of the original bit number may be output at different time, a mixed effect of human eyes may be caused, thereby having a visual effect of the bit number after real conversion, and a larger gray-scale value for display.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. Of course, the respective technical features mentioned in the same embodiment can also be combined arbitrarily as long as they have no collision with each other.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A driving device, connected to a signal output circuit and a display panel, respectively, and comprising:

a system on chip (SOC), connected to the signal output circuit, and configured to store an image data signal of each frame that is output by the signal output circuit and that is to be transmitted, and output a first image data signal after processing the image data signal, wherein the SOC is further configured to output a difference signal based on a signal difference between an image data signal of any current frame and an image data signal of a previous frame thereof; and a timing controller (TCON), connected to the display panel, and configured to receive the first image data signal and the difference signal, process the first image data signal based on the first image data signal and the difference signal, and output a second image data signal, wherein if the signal difference is smaller than a first specified value, the TCON is configured to:

output the second image data signal of the previous frame when a signal difference between the second image data signal of the current frame and the previous frame of second image data signal is greater than a second specified value; and output the second image data signal of the current frame when the signal difference between the second image data signal of the current frame and the second image data signal of the previous frame thereof is smaller than the second specified value.

2. The driving device according to claim 1, wherein the SOC comprises:

a first buffer circuit, connected to the signal output circuit, and configured to store and output the frame of image data signal that is output by the signal output circuit and that is to be transmitted;

a data comparison circuit, wherein an input end of the data comparison circuit is connected to the signal output circuit and the first buffer circuit, and the data comparison circuit is configured to output the difference signal based on the signal difference between the image data signal of any current frame and the image data signal of the previous frame thereof; and a first processing circuit, connected to the first buffer circuit and the TCON, and configured to receive the image data signal, and output the first image data signal after processing the image data signal.

3. The driving device according to claim 2, wherein the SOC further comprises:

an encoding circuit, wherein an input end of the encoding circuit is connected to the data comparison circuit and the first processing circuit, an output end of the encoding circuit is connected to the TCON, and wherein the encoding circuit is configured to receive the difference signal and the first image data signal, and encode and output the difference signal and the first image data signal.

4. The driving device according to claim 3, wherein the encoding circuit is a low voltage differential signal (LVDS) encoder.

5. The driving device according to claim 3, wherein the TCON further comprises:

a decoding circuit, connected to the encoding circuit, and configured to decode and output the difference signal and the first image data signal that are encoded by the encoding circuit.

6. The driving device according to claim 5, wherein the decoding circuit is an LVDS decoder.

7. The driving device according to claim 2, wherein the TCON comprises:

a second processing circuit, connected to the first processing circuit, and configured to receive the first image data signal, and output a second image data signal after processing the first image data signal;

a second buffer circuit, connected to the second processing circuit, and configured to store and output the second image data signal; and a selection circuit, wherein an input end of the selection circuit is connected to the data comparison circuit, the second processing circuit, and the second buffer circuit, an output end of the selection circuit is connected to the display panel, the selection circuit is configured to receive the difference signal, the second image data signal of the current frame, and the previous frame of second image data signal, and the selection circuit is configured to output the second image data signal of the previous frame when the signal difference is smaller than the first specified value and the signal difference between the second image data signal of the current frame and the second image data signal of the previous frame thereof is greater than the second specified value; and output the second image data signal of the current frame when the signal difference is smaller than the first specified value and the signal difference between the second image data signal of the current frame and the second image data signal of the previous frame thereof is smaller than the second specified value.

8. The driving device according to claim 7, wherein the second processing circuit comprises:

a color processing circuit, connected to the first processing circuit, and configured to receive the first image data signal, and correct the first image data signal by searching a lookup table stored in the color processing circuit, wherein the lookup table is a signal correction table of the first image data signal that is input and a first image data signal that is output.

9. The driving device according to claim 8, wherein the second processing circuit further comprises:

a digital gamma circuit, connected to the color processing circuit, and configured to receive the first image data signal corrected by the color processing circuit, and convert an original bit number of the corrected first image data signal, wherein the converted bit number is greater than the original bit number; and a jitter processing circuit, connected to the digital gamma circuit, and configured to receive a first image data signal converted by the digital gamma circuit, and output the original bit number of the converted first image data signal in a jitter manner.

10. The driving device according to claim 7, wherein the TCON further comprises:

an overdrive circuit, wherein an input end of the overdrive circuit is connected to the selection circuit and the second buffer circuit, an output end of the overdrive circuit is connected to the display panel, and wherein the overdrive circuit is configured to receive the second image data signal of the current frame and the previous frame of second image data signal, and enhance, by using the signal difference between the second image data signal of the current frame and the second image data signal of the previous frame thereof, a capability of outputting a signal by the selection circuit.

11. The driving device according to claim 2, wherein the first processing circuit comprises:

an expander circuit, connected to the first buffer circuit, and configured to receive the image data signal, and output the first image data signal after expanding the image data signal.

12. The driving device according to claim 11, wherein the expander circuit comprises:

a row expander circuit, connected to the first buffer circuit, and configured to extract each row of data from the image data signal, and perform row expanding on the row of data; and a column expander circuit, connected to the row expander circuit, and configured to extract each column of data of the image data signal on which the row expanding is performed, and perform column expanding on the column of data.

13. A driving device, comprising a system on chip (SOC) and a timing controller (TCON), wherein the SOC comprises:

a first buffer circuit, connected to a signal output circuit, and configured to store and output an image data signal of each frame that is output by the signal output circuit and that is to be transmitted;

a data comparison circuit, wherein an input end of the data comparison circuit is connected to the signal output circuit and the first buffer circuit, and the data comparison circuit is configured to output a difference signal based on a signal difference between the image data signal of any current frame and the image data signal of a previous frame thereof;

a first processing circuit, connected to the first buffer circuit, and configured to receive the image data signal, and output a first image data signal after processing the image data signal; and an encoding circuit, wherein an input end of the encoding circuit is connected to the data comparison circuit and the first processing circuit, an output end of the encoding circuit is connected to the TCON, and the encoding circuit is configured to receive the difference signal and the first image data signal, and encode and output the difference signal and the first image data signal; and the TCON comprises:

a decoding circuit, connected to the encoding circuit, and configured to decode and output the difference signal and the first image data signal that are encoded by the encoding circuit;

a second processing circuit, connected to the decoding circuit, and configured to receive the decoded first image data signal, and output a second image data signal after processing the first image data signal;

a second buffer circuit, connected to the second processing circuit, and configured to store and output the second image data signal; and a selection circuit, wherein an input end of the selection circuit is connected to the decoding circuit, the second processing circuit, and the second buffer circuit, an output end of the selection circuit is connected to a display panel; the selection circuit is configured to receive the difference signal, the second image data signal of a current frame, and the second image data signal of a previous frame; and wherein the selection circuit is configured to output the second image data signal of the previous frame when the signal difference is smaller than a first specified value and a signal difference between the second image data signal of the current frame and the second image data signal of the previous frame thereof is greater than a second specified value, and output the second image data signal of the current frame when the signal difference is smaller than the first specified value and the signal difference between the second image data signal of the current frame and the second image data signal of the previous frame thereof is smaller than the second specified value.

14. A driving method, based on the driving device according to claim 1, and comprising:

receiving, by a system on chip (SOC), an image data signal of each frame that is to be transmitted, and outputting a first image data signal after processing the image data signal; and outputting a difference signal based on a signal difference between the image data signal of any current frame and the image data signal of a previous frame thereof;

outputting, by a timing controller (TCON) based on the difference signal and the first image data signal, a second image data signal after processing the first image data signal;

outputting, by the TCON, the second image data signal of a current frame when the signal difference is smaller than a first specified value and a signal difference between the second image data signal of the current frame and the second image data signal of a previous frame is smaller than a second specified value; and outputting, by the TCON, the second image data signal of the previous frame when the signal difference is smaller than the first specified value and the signal difference between the second image data signal of the current frame and the second image data signal of the previous frame thereof is greater than the second specified value.

15. The driving method according to claim 14, wherein the receiving, by an SOC, an image data signal of each frame that is to be transmitted, and outputting a first image data signal after processing the image data signal specifically comprises:

receiving, by the SOC, the frame of image data signal that is to be transmitted, and outputting the first image data signal after expanding the image data signal.

16. The driving method according to claim 15, wherein the receiving, by the SOC, the frame of image data signal that is to be transmitted, and outputting the first image data signal after expanding the image data signal specifically comprises:

extracting, by the SOC, each row of data of the image data signal when receiving the frame of image data signal that is to be transmitted, performing twofold expanding processing on the row of data, extracting each column of data of the image data signal after the processing, and outputting the column of data after performing twofold expanding processing on the column of data.

17. The driving method according to claim 14, wherein the outputting, by a TCON a second image data signal after processing the first image data signal based on the difference signal and the first image data signal comprises:

outputting, by the TCON, based on the difference signal and the first image data signal, the second image data signal after correcting the first image data signal.

18. The driving method according to claim 17, wherein outputting the second image data signal after re-correcting the first image data signal further comprises:

converting, by the TCON, an original bit number of the corrected first image data signal, and outputting the original bit number in a jitter manner.

* * * * *